US006071200A

United States Patent [19]

Song

[11] Patent Number: 6,071,200

[45] Date of Patent: Jun. 6, 2000

[54] METALLIC GOLF CLUB WOOD HEAD

[75] Inventor: Yuan Lin Song, El Monte, Calif.

[73] Assignee: Golmax, Inc., El Monte, Calif.

[21] Appl. No.: 09/238,105

[22] Filed: Jan. 27, 1999

[51] Int. Cl.[7] ..... A63B 53/04

[52] U.S. Cl. ..... 473/345

[58] Field of Search ..... 473/324, 345, 473/350

[56] References Cited

U.S. PATENT DOCUMENTS

| | | | |
|---|---|---|---|
| 5,346,217 | 9/1994 | Tsuchiya et al. | 473/345 |
| 5,429,357 | 7/1995 | Kobayashi | 473/345 X |
| 5,485,998 | 1/1996 | Kobayashi | 473/345 |
| 5,556,097 | 9/1996 | Endo et al. | 473/345 X |
| 5,704,850 | 1/1998 | Shieh | 473/324 |
| 5,967,904 | 10/1999 | Nagai et al | 473/345 |
| 6,001,027 | 12/1999 | Hansberger | 473/345 X |

*Primary Examiner*—John A. Ricci

*Attorney, Agent, or Firm*—Raymond Y. Chan; David and Raymond

[57] ABSTRACT

A metallic golf club wood head includes a face crust, a crown crust and a sole and side crust combined together with a hosel, wherein a face-enhancing member is integrally extended from a front edge of the crown downwardly or from a front edge of the sole and side crust upwardly and the face crust can be precisely and easily mounted on the face-enhancing member. Moreover, the loft angle of the face crust can be adjusted simply by altering the inclined angle of the face-enhancing member, which can be easily adjusted by simply folding inwardly or outwardly with respect to the crown crust or the to sole and side crust. In addition, the face-enhancing member is positioned with respect to the sweet spot of the face crust so as to better support and enhance impacting of the sweet spot.

20 Claims, 5 Drawing Sheets

METALLIC GOLF CLUB WOOD HEAD

FIELD OF THE PRESENT INVENTION

The present invention relates to golf club, and more particularly to a hollow metallic golf club head of the so-called "wood" head type, which has a face-enhancing member integrally extended from a sole and side crust or a crown crust thereof so as to facilitate a face crust properly aligned and affixed in position and to better support and enhance the impacting sweet spot of the face crust.

BACKGROUND OF THE PRESENT INVENTION

Hollow metallic golf club wood heads are well known in arts as disclosed in U.S. Pat. Nos. 5,429,357, 5,460,371, and 5,485,998. Generally, a metallic golf club wood head comprises a rear shell member and a planer face member combined together with a hosel. The rear shell member contributes the major weight of the club head for providing a steady swing. The face member is the most important element of the club head because it is the substantial part hitting the golf ball. The inclined loft angle of the face member determines the height and distance of the golf ball to be driven. The face member also forms the impact plane that should be aligned in predetermined angle with the golf shaft. In other words, if the face member is wrongfully aligned or affixed in position just a bit, the performance of the golf club will be largely discounted.

Accordingly, due to the fact that the face member is affixed on the club head by welding the periphery edge of the face member to the boundary of a front opening of the rear shell member, a great deal of care and time must normally be consumed for rigidly mounting the face member on the rear shell member of the club head. Even though much cost and labor are invested, mis-alignments of the face member are still happened easily and frequently.

Besides, to an average professional golfer, he or she will hit the ball on the sweet spot almost every time. Therefore, the face member will soon be damaged at the sweet spot. A good and handy golf wood club not only is expensive but also is unreplacable to a golfer. It would be a remarkable appreciation for most golfers if their wood clubs have a longer life span.

Moreover, a face member has bigger elasticity when it has thinner thickness for better controlling for sliding and hooking. However, the face member is not suggested to have a thickness thinner than 3.2 mm due to rigidity and construction concern. For a 3.2 mm thick titanium alloy face member, the overall weight of a golf club head will be more than 185 to 190 g when a preferred weight of a 300 c.c. golf club head is equal to or less than 180 g.

SUMMARY OF THE PRESENT INVENTION

The main object of the present invention is to provide a metallic golf club wood head which can facilitate the face crust to be properly aligned and affixed in position to form the club head.

Another object of the present invention is to provide a metallic golf club wood head which can better support and enhance impacting of the sweet spot of the face crust.

Another object of the present invention is to provide a metallic golf club wood head that has a longer life span.

Another object of the present invention is to provide a metallic golf club wood head which enables a reduction in the manufacturing operations and a reduction in cost.

Another object of the present invention is to provide a metallic golf club wood head wherein the loft angle can be easily adjusted in manufacture and the structural members thereof, especially the face crust, can be easily connected together.

Another object of the present invention is to provide a metallic golf club wood head wherein the thickness of the face member can be minimized to increase the elasticity while it is reinforced and supported by the face-enhancing member.

Accordingly, in order to accomplish the above objects, the present invention provides a metallic golf club wood head which comprises a face crust, a crown crust and a sole and side crust combined together with a hosel, wherein a face-enhancing member is integrally extended from a front edge of the crown downwardly or from a front edge of the sole and side crust upwardly and the face crust can be precisely and easily mounted on the face-enhancing member.

Moreover, the loft angle of the face crust can be adjusted simply by altering the inclined angle of the face-enhancing member, which can be easily adjusted by simply folding inwardly or outwardly with respect to the crown crust or the sole and side crust.

In addition, the face-enhancing member is preferred to be positioned with respect to the sweet spot of the face crust so as to better support and enhance the impacting sweet spot.

DETAILED DESCRIPTION OF THE PREFERRED EMBODIMENT

Figure 2:
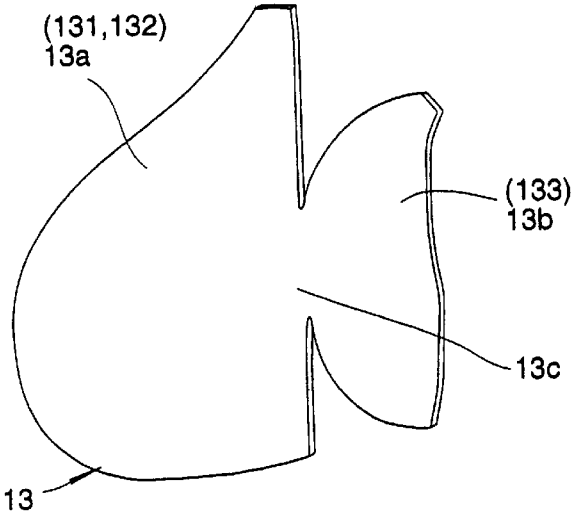
FIG. 2 is a perspective view of the sole and side crust before forging according to the above first preferred embodiment of the present invention.
Figure 1:
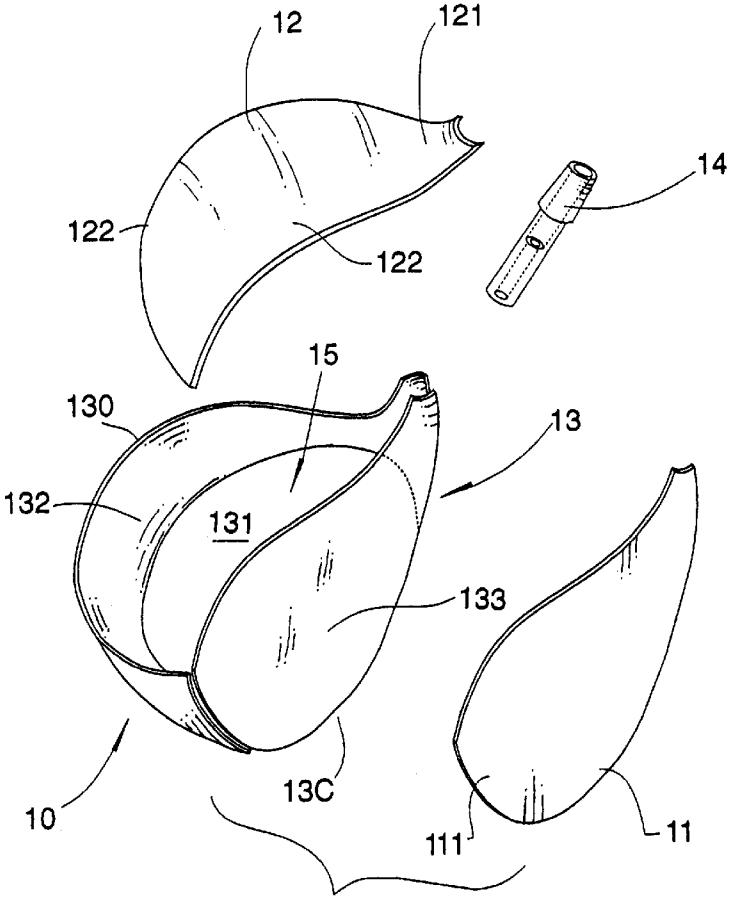
FIG. 1 is an exploded perspective view of a metallic golf club wood head before being welded together according to a first preferred embodiment of the present invention.
Figure 3:
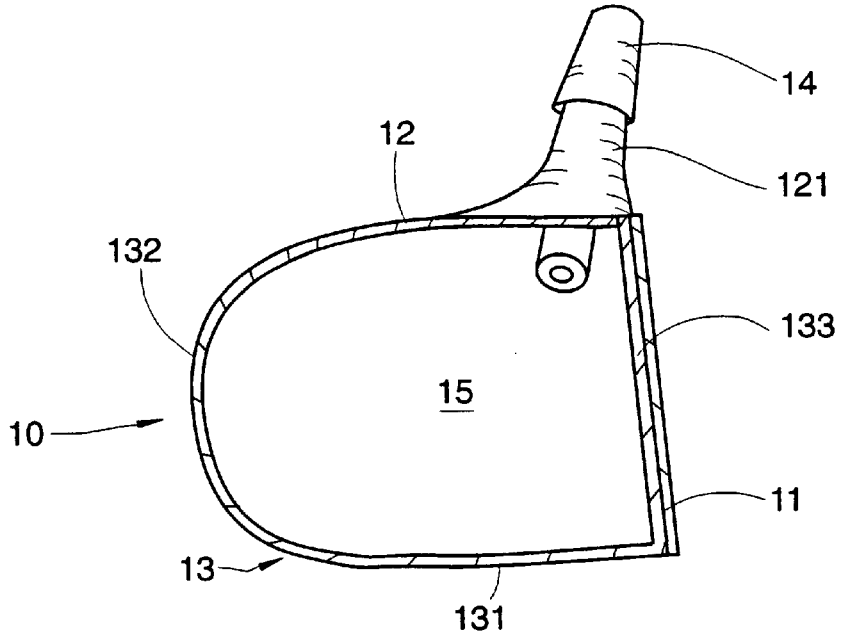
FIG. 3 is a sectional view of the metallic golf club wood head after being welded together according to the above first preferred embodiment of the present invention.

Referring to FIGS. 1 to 3, a metallic golf club wood head according to a first preferred embodiment of the present invention comprises a head body 10 which is integrally formed by welding and combining a face crust 11, a crown crust 12 and a sole and side crust 13 together with a hosel 14 so as to form a hollow interior cavity 15 therein. The crusts are formed by press working of metal plates of titanium, titanium alloy, aluminum alloy, and etc. The face crust 11 forms a front impact surface 111. One side of the crown crust 12 is provided with a semi-cylindrical member 121 extending obliquely upward.

As shown in FIG. 2, the sole and side crust 13 is cut from metal plate to form a larger sole and side half 13*a* and a smaller face enhancing half 13*b* which is integrally connected with the sole and side half 13*a* by a segment of connecting edge 13*c* (extended therebetween.

Referring to FIGS. 1 and 2, the sole and side crust 13 as shown in FIG. 1 is shaped by forging the sole and side half 13*a* to form a sole 131 in a lower part thereof and a periphery side 132, and folding the face enhancing half 13*b* up towards the periphery side 132 along the connecting edge 13*c* to form a face-enhancing member 133 as shown in FIG. 1, wherein the face-enhancing member 133 is still connected with the sole 131 through the connecting edge 13*c*. Therefore, the inclined angle of the face-enhancing member 133 with respect to the sole 131 can easily be adjusted by folding the face-enhancing member 133 inwardly or outwardly.

As shown in FIGS. 1 and 3, when the face-enhancing member 133 is bent in predetermined angle and position, two side edges of the face-enhancing member 133 are respectively welded with the front edges of the periphery side 132 of the sole and side crust 13, so that top edges of the periphery side 132 and the face-enhancing member 133 contribute a top peripheral side 130 which is welded with the periphery edge 122 of the crown crust 12 to form the head body 10. The hosel 14 is sandwiched by the head body 10. Then, the face crust 11 is attached to the face-enhancing member 133, wherein the loft angle of the face crust 11, that is the inclined angle of the face-enhancing member 133, can be precisely and easily adjusted by slightly folding the face-enhancing member 133 inwards or outwards.

In addition, the face-enhancing member 133 is preferred to be positioned with respect to the sweet spot of the face crust 11, so as to better support and enhance the impacting sweet spot of the face crust 11 that can prolong the service life span of the club head. It should be noticed that if a lighter golf head is desired, the face-enhancing member 133 itself can be served as the impacting face surface, so that the face crust 11 can be eliminated to reduce cost and weight.

Figure 6:
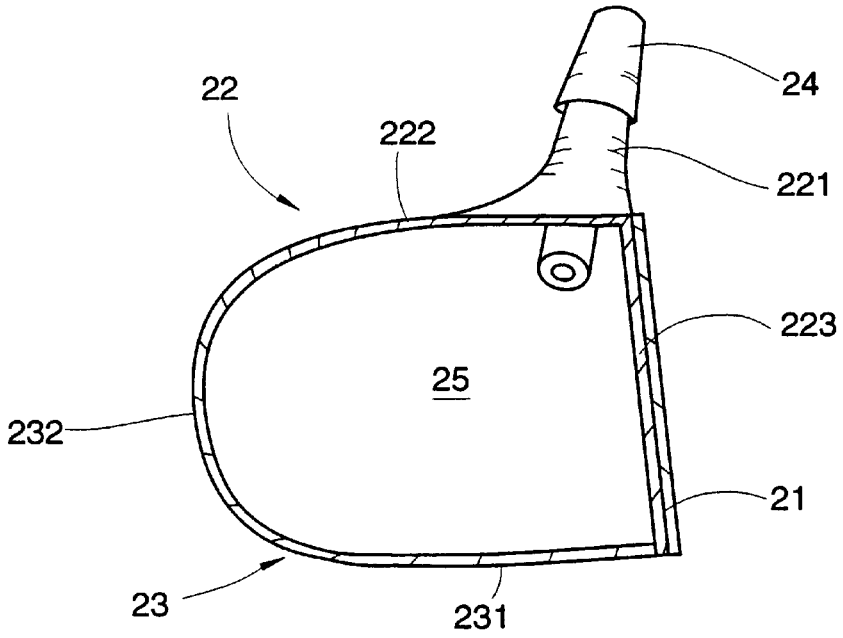
FIG. 6 is a sectional view of the metallic golf club wood head after being welded together according to the above first preferred embodiment of the present invention.
Figure 5:
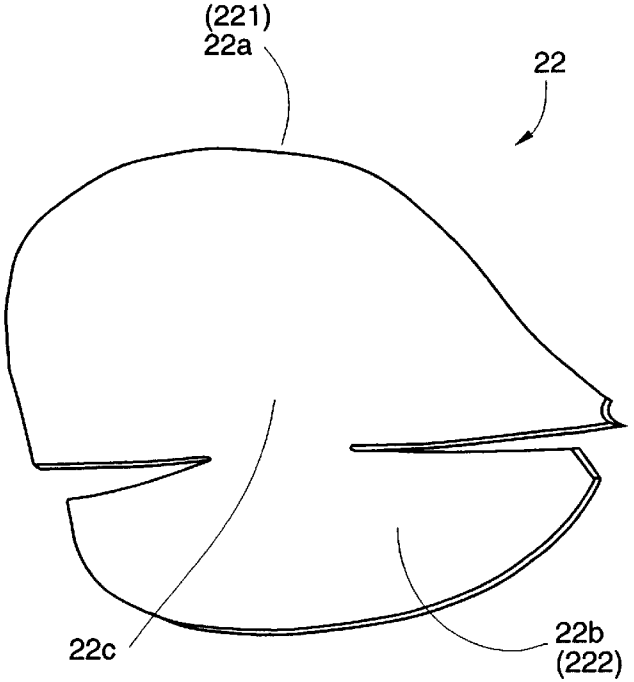
FIG. 5 is a perspective view of the crown crust before forging according to the above second preferred embodiment of the present invention.
Figure 4:
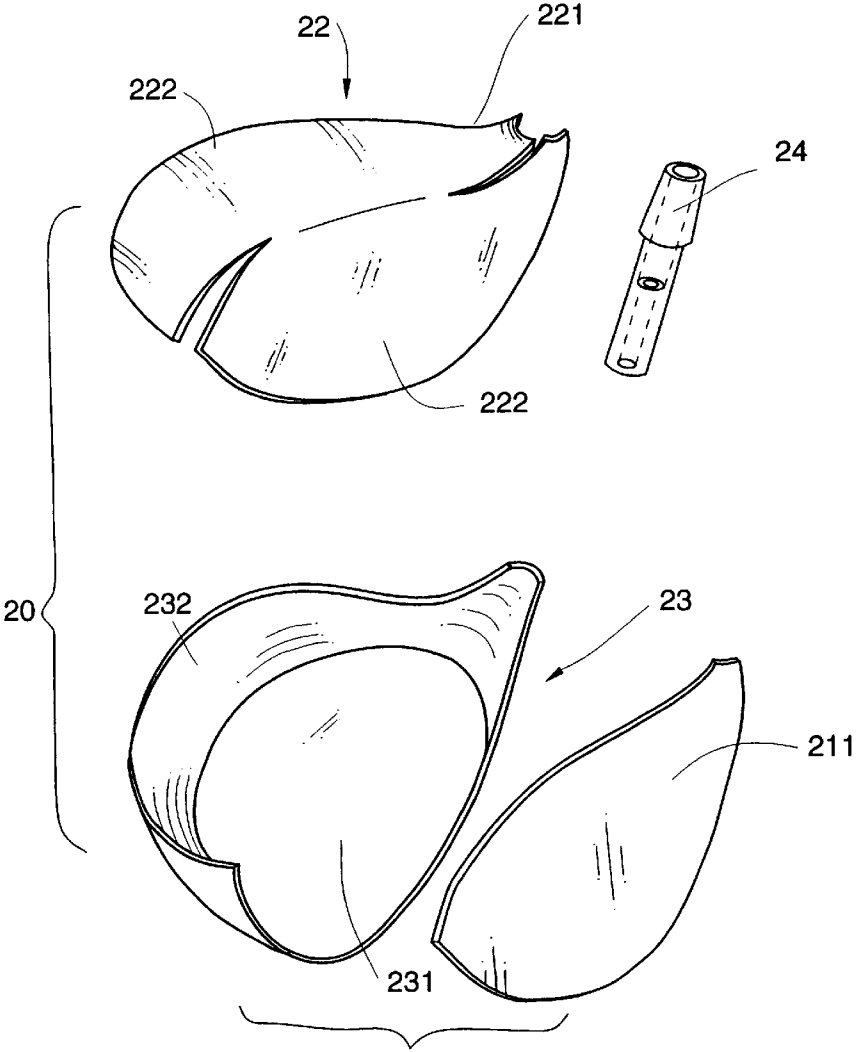
FIG. 4 is an exploded perspective view of a metallic golf club wood head before being welded together according to a second preferred embodiment of the present invention.

Referring to FIGS. 4 to 6, a second preferred embodiment of the present invention is illustrated, wherein the metallic golf club wood head also comprises a head body 20 which is integrally formed by welding and combining a face crust 211, a crown crust 22 and a sole and side crust 23 together with a hosel 24 so as to form a hollow interior cavity 25 therein. Similarly to the above first embodiment, the crusts are formed by press working of metal plates of titanium, titanium alloy, aluminum alloy, and etc. The face crust 21 forms a front impact surface 211.

Referring to FIG. 4, the sole and side crust 23 is shaped by forging to form a sole 231 in a lower part thereof and a periphery side 232. As shown in FIG. 5, instead of the sole and side crust 13 in the above first embodiment, according to the present second embodiment, the crown crust 22 is cut from metal plate to form a larger crown half 22*a* and a smaller face enhancing half 22*b* which is integrally connected with the crown half 22*a* by a segment of connection edge 22*c* extended therebetween.

Referring to FIGS. 4 and 5, the crown crust 22 as shown in FIG. 4 is shaped by pressing the crown half 22*a* to form a crown member 222 thereof, and folding the face enhancing half 22*b* down towards the sole 231 along the connection edge 22*c* to form a face-enhancing member 223 as shown in FIG. 4, wherein the face-enhancing member 223 is still connected with the crown member 222 through the connection edge 22*c*. Therefore, the inclined angle of the face-enhancing member 223 with respect to the sole 231 can easily be adjusted by folding the face-enhancing member 223 inwardly or outwardly. One side of the crown crust 22 is provided with a semi-cylindrical member 221 extending obliquely upward.

As shown in FIGS. 4 and 6, when the face-enhancing member 223 is bent in predetermined angle and position, two side edges of the face-enhancing member 223 are respectively welded with the front edges of the crown member 222, so that a top edge of the periphery side 232 is welded with the side edge of the crown member 222 and the front edge of the periphery side 232 is welded with the peripheral edge of the face-enhancing member 223 to form the head body 20. The hosel 24 is sandwiched by the head body 20. Then, the face crust 21 is attached to the face-enhancing member 223, wherein the loft angle of the face crust 21, that is the inclined angle of the face-enhancing member 223, can also be precisely and easily adjusted by slightly folding the face-enhancing member 223 inwards or outwards.

Same as the above first embodiment, the face-enhancing member 223 is preferred to be positioned with respect to the sweet spot of the face crust 21, so as to better support and enhance the impacting sweet spot of the face crust 21 that can prolong the service life span of the club head. It is also worth to mention that if a lighter golf head is desired, the face-enhancing member 223 itself of the second embodiment can also serve as the impacting face surface, so that the face crust 21 is able to be eliminated to reduce cost and weight accordingly.

Figure 7:
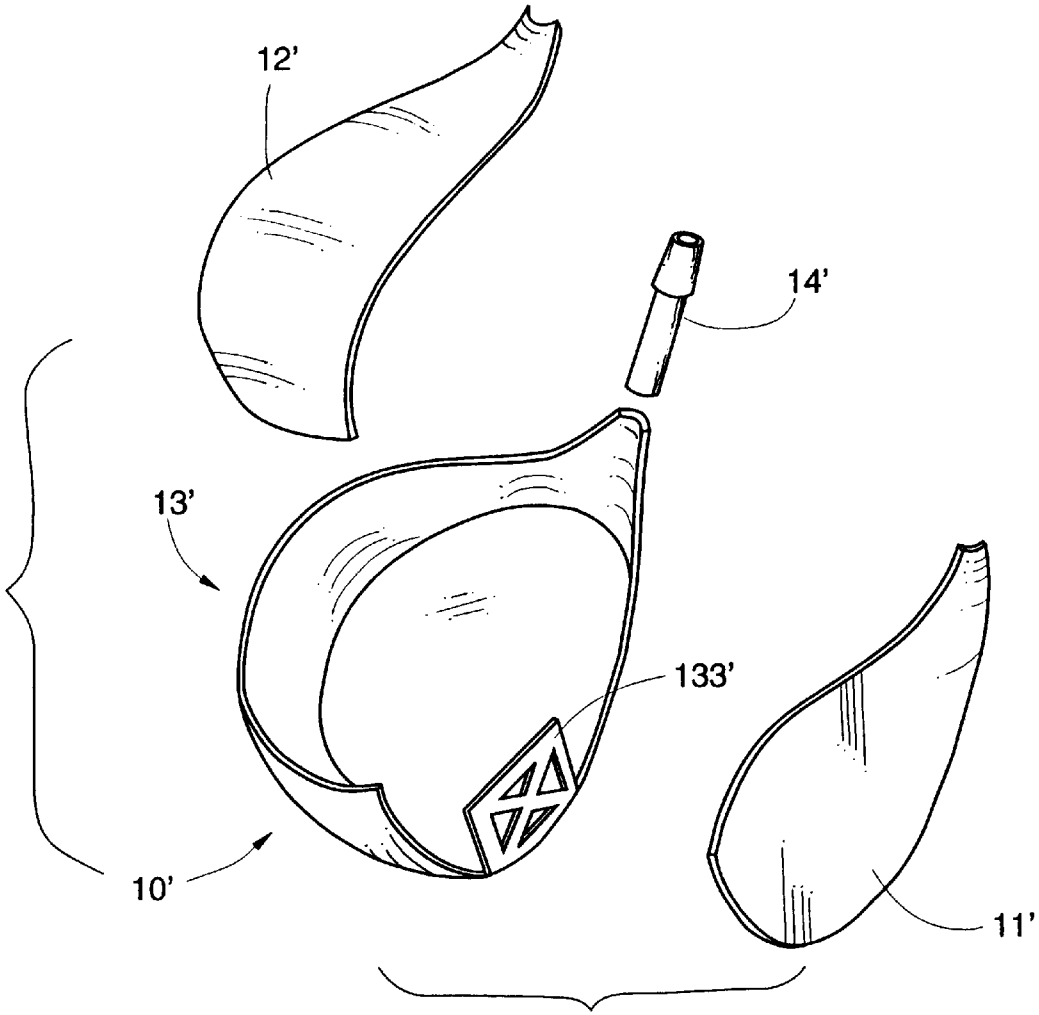
FIG. 7 is an exploded perspective view of an alternative mode of the metallic golf club wood head according to the above first preferred embodiment of the present invention.

Referring to FIG. 7, an alternative mode of the above first embodiment is illustrated, wherein the face-enhancing member 133 as shown in FIGS. 1 to 3 is substituted by a smaller reinforcing frame to serve as a face-enhancing member 133', which is also integrally and upwardly extended from a front edge of the sole and side crust 13' and must be positioned with respect to the sweet spot of the face crust 11'. Therefore, the face crust 11' can be easily mounted on the face-enhancing member 133' so as to precisely aligned the face crust 11' in predetermined loft angle and impacting plane with respect to the sole and side crust 13'. The loft angle of the face crust 11' can be adjusted simply by altering the inclined angle of the face-enhancing member 133', which can be easily adjusted by simply folding inwardly or outwardly with respect to the crown crust 12' or the sole and side crust 13' of the head body 10'.

Figure 8:
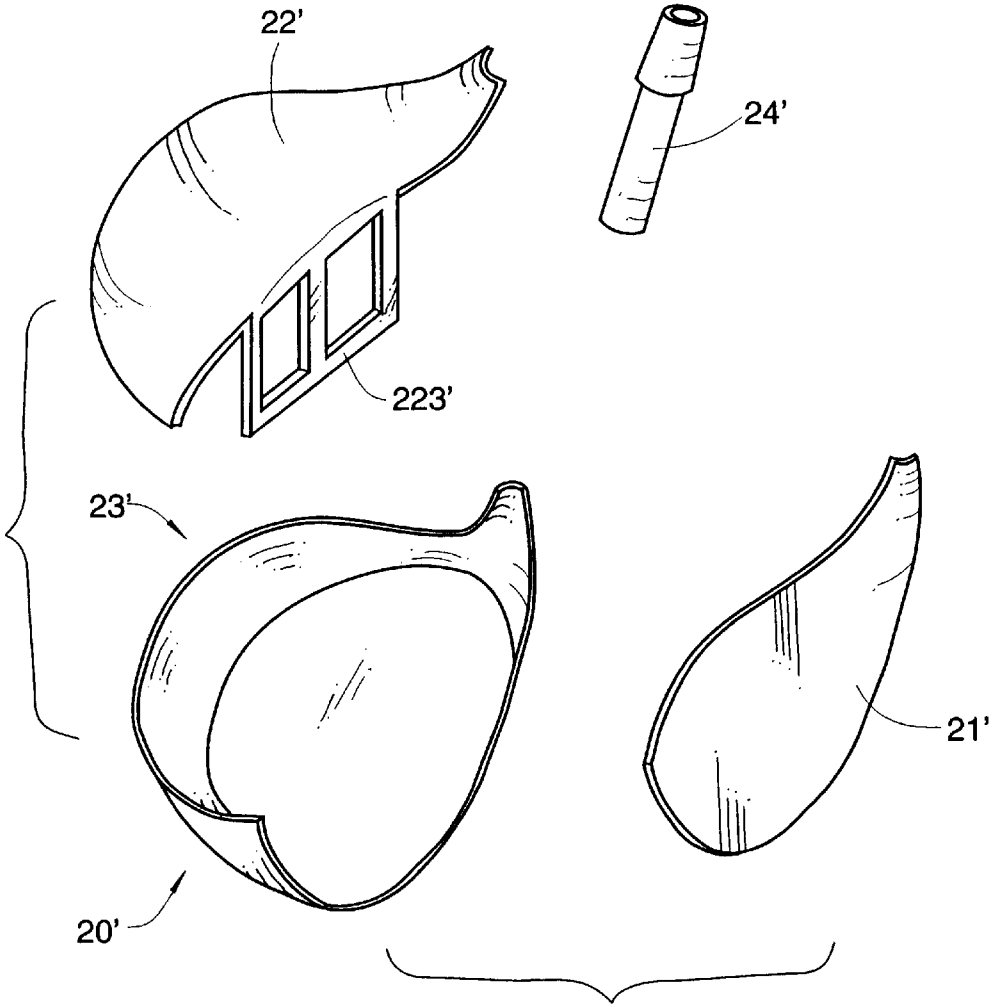
FIG. 8 is an exploded perspective view of an alternative mode of the metallic golf club wood head according to the above second preferred embodiment of the present invention.

Referring to FIG. 8, an alternative mode of the above second embodiment is illustrated, wherein the face-enhancing member 223 as shown in FIGS. 4 to 6 is substituted by a smaller reinforcing frame to serve as a face-enhancing member 223', which is also integrally and downwardly extended from a front edge of the crown crust 22' and must be positioned with respect to the sweet spot of the face crust 21'. Therefore, the face crust 21' can be easily mounted on the face-enhancing member 223' so as to precisely aligned the face crust 21' in predetermined loft angle and impacting plane with respect to the sole and side crust 23'. The loft angle of the face crust 21' can be adjusted simply by altering the inclined angle of the face-enhancing member 223', which can be easily adjusted by simply folding inwardly or outwardly with respect to the crown crust 22' or the sole and side crust 23' of the head body 20'.

In view of above, by integrally connected a face-enhancing member from the crown crust or the sole and side crust can substantially achieve advantages over the prior arts as follows.

A. The presence of the face-enhancing member can facilitate the face crust to properly aligned and affixed in position to form the club head.

B. The face-enhancing member can better support and enhance the impacting sweet spot of the face crust.

C. It has a longer life span and enables a reduction in the manufacturing operations and a reduction in cost.

D. The loft angle can be easily adjusted in manufacture and the structural members thereof, especially the face crust, can be easily connected together.

E. A face member has bigger elasticity when it has a thinner thickness for better controlling for sliding and hooking. According to the present invention, the thickness of the face member can be minimized to increase the elasticity while it is reinforced and supported by the face-enhancing member. Practically, the thickness of a titanium alloy face member can be reduced to 2 mm so as to minimize the overall weight of a 300 c.c. golf club head to 180 g or less.

What is claimed is:

1. A metallic golf club wood head, comprising a head body which is integrally formed by welding and combining a face crust, a crown crust and a sole and side crust together with a hosel so as to form a hollow interior cavity, wherein said sole and side crust has a sole in a lower part thereof and a periphery side, said head body further comprising a face-enhancing member integrally connected with a front edge of said sole of said sole and side crust through a connecting edge, wherein said face-enhancing member is upwardly extended with an inclined angle with respect to said sole, and said face crust is attached to said face-enhancing member.

2. A metallic golf club wood head, as recited in claim 1, wherein said face-enhancing member is positioned with respect to a sweet spot of said face crust, so as to support and enhance impacting of said sweet spot of said face crust.

3. A metallic golf club wood head, as recited in claim 2, wherein said sole and side crust is cut from metal plate to form a larger sole and side half and a smaller face enhancing half which is integrally connected with said sole and side half by said connecting edge extended therebetween, said sole and side crust is shaped by forging said sole and side half to form said sole in a lower part thereof and said periphery side, and folding the face enhancing half up towards said periphery side along said connecting edge to form said face-enhancing member.

4. A metallic golf club wood head, as recited in claim 3, wherein said face-enhancing member is bent in predetermined angle and position, and two side edges of said face-enhancing member are respectively welded with front edges of said periphery side of said sole and side crust, so that top edges of said periphery side and said face-enhancing member contribute a top peripheral side which is welded with a periphery edge of said crown crust to form said head body.

5. A metallic golf club wood head, as recited in claim 3, wherein said face-enhancing member is a reinforcing frame having a size fitted to support and reinforce the face crust mounted thereon.

6. A metallic golf club wood head, as recited in claim 2, wherein said face-enhancing member is bent in predetermined angle and position, and two side edges of said face-enhancing member are respectively welded with front edges of said periphery side of said sole and side crust, so that top edges of said periphery side and said face-enhancing member contribute a top peripheral side which is welded with a periphery edge of said crown crust to form said head body.

7. A metallic golf club wood head, as recited in claim 2, wherein said face-enhancing member is a reinforcing frame having a size fitted to support and reinforce the face crust mounted thereon.

8. A metallic golf club wood head, as recited in claim 1, wherein said sole and side crust is cut from metal plate to form a larger sole and side half and a smaller face enhancing half which is integrally connected with said sole and side half by said connecting edge extended therebetween, said sole and side crust is shaped by forging said sole and side half to form said sole in a lower part thereof and said periphery side, and folding the face enhancing half up towards said periphery side along said connecting edge to form said face-enhancing member.

9. A metallic golf club wood head, as recited in claim 1, wherein said face-enhancing member is bent in predetermined angle and position, and two side edges of said face-enhancing member are respectively welded with front edges of said periphery side of said sole and side crust, so that top edges of said periphery side and said face-enhancing member contribute a top peripheral side which is welded with a periphery edge of said crown crust to form said head body.

10. A metallic golf club wood head, as recited in claim 1, wherein said face-enhancing member is a reinforcing frame having a size fitted to support and reinforce the face crust mounted thereon.

11. A metallic golf club wood head, comprising a head body which is integrally formed by welding and combining a face crust, a crown crust and a sole and side crust together with a hosel so as to form a hollow interior cavity, wherein said sole and side crust is shaped by forging to form a sole in a lower part thereof and a periphery side, wherein said crown crust comprises a crown member and a face-enhancing member integrally connected with a front edge of said crown member through a connection edge, said face-enhancing member being downwardly extended from said crown member with an inclined angle with respect to said sole, and said face crust is attached to said face-enhancing member.

12. A metallic golf club wood head, as recited in claim 11, wherein said face-enhancing member is positioned with respect to a sweet spot of said face crust, so as to support and reinforce said sweet spot of said face crust.

13. A metallic golf club wood head, as recited in claim 12, wherein said crown crust is cut from metal plate to form a larger crown half and a smaller face enhancing half which is integrally connected with said crown half by said connection edge extended therebetween, wherein said crown crust is shaped by pressing said crown half to form said crown member, and folding said face enhancing half down towards said sole along said connection edge to form said face-enhancing member.

14. A metallic golf club wood head, as recited in claim 13, wherein said face-enhancing member is bent in predetermined angle and position, and two side edges of said face-enhancing member are respectively welded with front edges of said crown member, so that a top edge of said periphery side is welded with a side edge of said crown member and a front edge of said periphery side is welded with a peripheral edge of said face-enhancing member to form said head body.

15. A metallic golf club wood head, as recited in claim 13, wherein said face-enhancing member is a reinforcing frame having a size fitted to support and reinforce the face crust mounted thereon.

16. A metallic golf club wood head, as recited in claim 12, wherein said face-enhancing member is bent in predetermined angle and position, and two side edges of said face-enhancing member are respectively welded with front edges of said crown member, so that a top edge of said periphery side is welded with a side edge of said crown member and a front edge of said periphery side is welded with a peripheral edge of said face-enhancing member to form said head body.

17. A metallic golf club wood head, as recited in claim 12, wherein said face-enhancing member is a reinforcing frame having a size fitted to support and reinforce the face crust mounted thereon.

18. A metallic golf club wood head, as recited in claim 11, wherein said crown crust is cut from metal plate to form a larger crown half and a smaller face enhancing half which is integrally connected with said crown half by said connection edge extended therebetween, wherein said crown crust is shaped by pressing said crown half to form said crown member, and folding said face enhancing half down towards said sole along said connection edge to form said face-enhancing member.

19. A metallic golf club wood head, as recited in claim 11, wherein said face-enhancing member is bent in predetermined angle and position, and two side edges of said face-enhancing member are respectively welded with front edges of said crown member, so that a top edge of said periphery side is welded with a side edge of said crown member and a front edge of said periphery side is welded with a peripheral edge of said face-enhancing member to form said head body.

20. A metallic golf club wood head, as recited in claim 11, wherein said face-enhancing member is a reinforcing frame having a size fitted to support and reinforce the face crust mounted thereon.

* * * * *